United States Patent [19]

Rouvellat et al.

[11] 4,077,770

[45] Mar. 7, 1978

[54] TEXTILE CLEANING PROCESS INCLUDING SOIL-REPELLENT FINISH

[76] Inventors: Richard A. Rouvellat, 3620 Moreno Ave., No. 136, La Verne, Calif. 91750; Minoru Wada, 3067 Corda Dr., Los Angeles, Calif. 90049; Shoji Yoshihara, 604 Marek Dr., Montebello, Calif. 90640

[21] Appl. No.: 705,408

[22] Filed: Jul. 15, 1976

[51] Int. Cl.[2] ..... D06L 1/00

[52] U.S. Cl. ..... 8/142; 8/137; 252/8.6; 427/390 E

[58] Field of Search ..... 8/142; 252/8.6; 427/390

[56] References Cited

U.S. PATENT DOCUMENTS

| | | | |
|---|---|---|---|
| 2,061,211 | 11/1936 | Reddish | 8/142 |
| 3,345,424 | 10/1967 | Hauptschein et al. | 252/8.6 |
| 3,486,911 | 12/1969 | Goldstein | 252/8.6 |
| 3,854,871 | 12/1974 | Eanzel | 427/322 |
| 3,920,389 | 11/1975 | Eanzel | 8/142 |

*Primary Examiner*—William E. Schulz
*Attorney, Agent, or Firm*—Theodore H. Lassagne

[57] ABSTRACT

In an industrial dry cleaning operation in which wrinkles are removed from the cleaned garments by suspending them in a heated atmosphere, the garments are rendered soil-resistant by spraying them with a liquid containing a dilute polyfluoroalkyl stain repellent after cleaning and prior to suspending them in a heated atmosphere in which they are heated for a time period and at a temperature sufficient to first evaporate said liquid and then to set the stain repellent concurrently with the removal of wrinkles.

9 Claims, 1 Drawing Figure

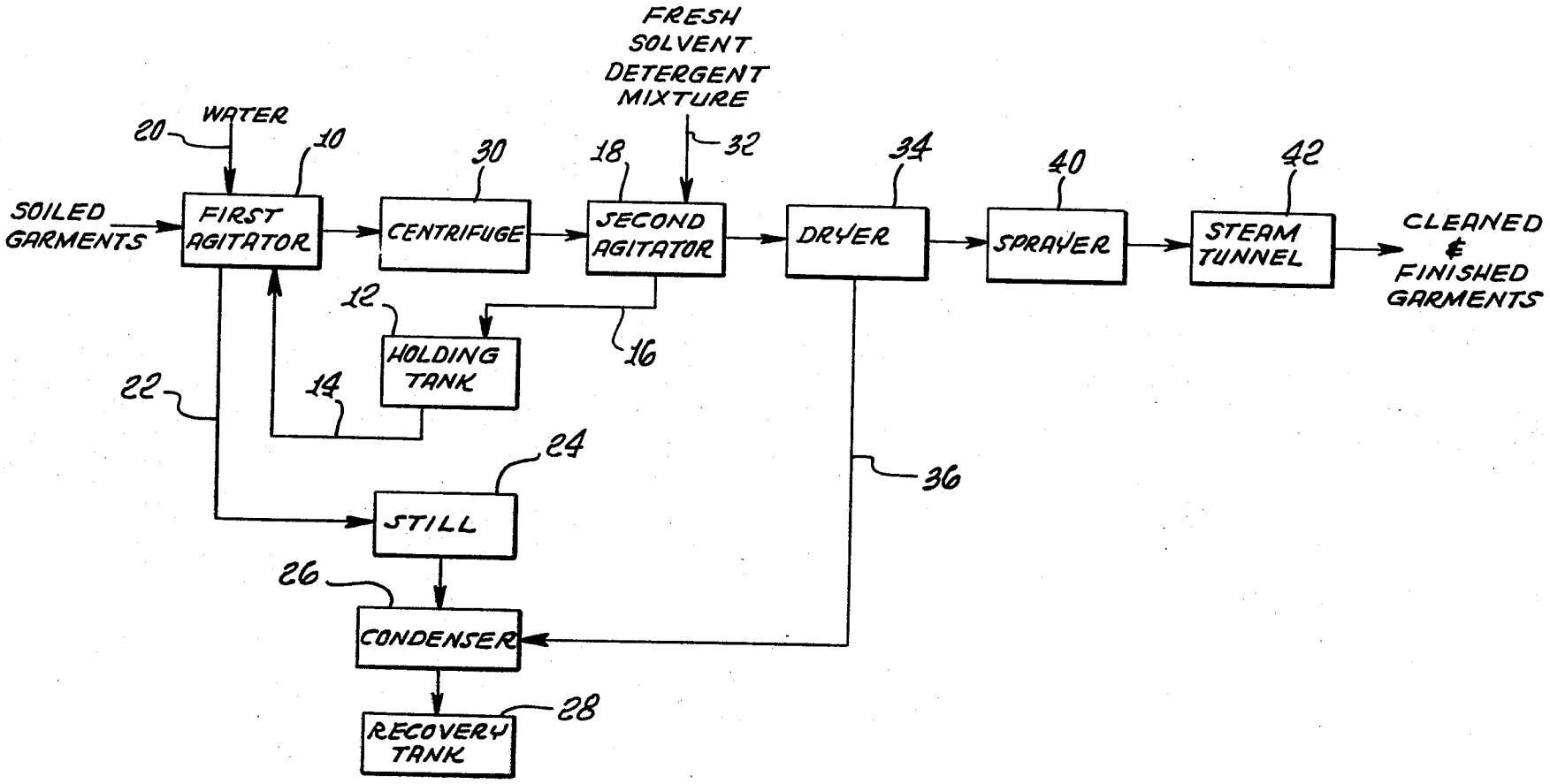
SOILED GARMENTS
WATER
20
FIRST AGITATOR
10
CENTRIFUGE
30
SECOND AGITATOR
18
FRESH SOLVENT DETERGENT MIXTURE
32
DRYER
34
SPRAYER
40
STEAM TUNNEL
42
CLEANED & FINISHED GARMENTS
HOLDING TANK
12
14
16
22
STILL
24
CONDENSER
26
36
RECOVERY TANK
28

TEXTILE CLEANING PROCESS INCLUDING SOIL-REPELLENT FINISH

BACKGROUND OF THE INVENTION

1. Field of the Invention

The invention relates to the treatment of fabrics to enhance their resistance to soiling, and more particularly to a novel process of so treating garments in the course of a conventional industrial dry cleaning operation without modification of any part of such an operation.

2. The Prior Art

The business of rental and cleaning of industrial garments involves repeated cleanings of fabrics which are exposed, between such cleanings, to heavy soiling as, for example, by automobile oils and greases carrying carbon particles in suspension.

When the fabrics composing such garments were woven of natural fibers, staining from such sources could be removed by and agitation in a high-temperature water-detergent mixture.

With the advent of synthetic fabrics, however, and their wide adoption for use in industrial garments, especially work shirts, it became impracticable to remove such stains by such means because of the effect of high temperatures on the strength of polyesters and like synthetic fabrics, and dry cleaning of them became a necessity.

In conventional dry cleaning, garments usually are manually "spotted" to remove heavy soil from limited areas. They then are cleaned by agitation in a mixture of an organic solvent, detergent and water which is being continuously recycled and filtered to remove suspended insoluble material; a portion only of the mixture being distilled in the course of such recycling, to prevent excessive accumulation of contaminents. Finishes such as stain repellents may be applied during or following such cleaning and thereafter "set," as described, for example, in the U.S. Pat. of Eanzel No. 3,854,871 and other patents referred to therein.

The degree of soil encountered in the industrial garment rental and cleaning business, and the economic factors prevailing in that industry, render it uneconomical to clean such garments by such a conventional dry cleaning method. The removal of stains by manual "spotting" is obviously excessively costly. The amount of insoluble material carried into suspension is too great to permit its removal in a continuous filtering operation because a conventional filter would soon be clogged. The application of a stain repellent finish, while obviously desirable, has involved excessive material and labor costs and therefore has seldom if ever been used.

Therefore, in industrial dry cleaning, as distinguished from that just described, it has been the practice to agitate a batch of garments such as shirts in a solvent-detergent-water mixture in which (prior to addition of water to the mixture) another batch of such garments, previously so processed, has already been agitated. The twice-used solvent-detergent-water mixture is then distilled to recover the solvent. Following the first agitation described, the batch of garments is subjected to a second agitation in a fresh solvent-detergent mixture after which that mixture, with water added, is used once more for the agitation of a new batch of soiled garments and then distilled as has been described. After drying, by centrifugation, solvent aspiration, etc., the garments are passed on hangers through a dry-steam finishing tunnel in which the application of heat and agitation of the garments effects the removal of wrinkles.

The application of a stain repellent finish to garments in the course of such an industrial dry cleaning process has heretofore proven uneconomical because such a repellent, if mixed with the solvent-detergent-water mixture, would, except for the small amount coated onto the fabric, be lost during the distillation operation; or, if sprayed on the garments in a separate operation at the conclusion of the cleaning operation as taught in the prior art, would involve excessive time and labor costs.

It is the primary object of the present invention, therefore, to provide an industrial dry cleaning process of the character described including provision for the application and setting of a stain repellent finish to the cleaned garments without modifying any of the steps described or increasing the time required for the completing of the cleaning and drying operation.

SUMMARY OF THE INVENTION

According to the present invention, a liquid stain repellent material is applied to one surface of the garments just prior to their entry into the conventional steam tunnel employed for wrinkle removal; this tunnel being maintained at a temperature sufficient to first evaporate the liquid phase of the stain repellent remaining on the garments and then to "set" the stain repellent material during its passage through the tunnel.

By confining the spray application to one surface of the garment, ordinarily that subjected to the heaviest soiling as, for example, the front outer surface of a work shirt, it has been found possible to effect wrinkle removal concurrently with setting of the stain repellent, without any change in the time of exposure or temperature within the steam tunnel as compared with prior practice in which no stain repellent was applied. Also, the inner surface of the shirt is left more absorbent to perspiration than it would be if made stain repellent.

Thus the application and setting of an effective stain repellent material can be economically and efficiently effected without modification of any of the materials conventionally employed in the industrial dry cleaning operation and without adding to the time required for the completion of the operation.

The deposition and setting of the stain repellent material on the fibers of the fabric facilitates the release therefrom of insoluble as well as soluble soil in subsequent dry cleaning operations. It has been found, furthermore, that a significant amount of the stain repellent material is retained on the fibers after such subsequent dry cleaning operations, so that the clothing which has previously been treated in accordance with the present invention need only be sprayed with a more dilute concentration of the stain repellent material in subsequent dry cleaning operations.

BRIEF DESCRIPTION OF THE DRAWING

The drawing is a flow diagram illustrating the sequence of operations hereinafter described.

DESCRIPTION OF THE PREFERRED EMBODIMENT

EXAMPLE I

Step 1. Into a rotary agitator 10 (see the accompanying flow diagram) containing approximately 100 pounds (45 kg.) of soiled work shirts not previously treated with stain repellent there was introduced from holding tank 12 via line 14 80 gallons (304 liters) of the liquid mixture drained via line 16 from the rotary agitator 18 employed in Step 3, hereinafter described, plus 2½ gallons (9.5 liters) of water introduced via line 20. The garments were thoroughly agitated in this liquid mixture, at about room temperature, 75° to 90° F. (24° to 32° C.) for at least ten minutes.

Step 2. The liquid mixture was then dumped through line 22 to a still 24 for subsequent recovery in condenser 26 of the perchlorethylene content which is held in recovery tank 28 for reuse. The garments were then extracted by centrifuging at station 30 for about 1½ minutes.

Step. 3. Into a rotary agitator 18 containing the partially cleaned work shirts, the following liquid mixture was introduced via line 32:

80 gallons (304 liters) perchlorethylene; and 24 fluid ounces (720 ml.) of a detergent such as any of the class of dry cleaning soaps and synthetic detergents described in U.S. Pat. No. 3,091,508.

The garments were thoroughly agitated in this mixture, at the aforesaid room temperature, for at least ten minutes and the liquid mixture was then drained through line 16 to holding tank 12 for reuse with a new batch of soiled garments as described in Step 1, above.

Step 4. The garments were then dried at 34 by first centrifuging in a closed vessel from which the perchlorethylene evaporated from the clothing was conducted by line 36 to condenser 26 for recovery of liquid perchlorethylene, and then completing the drying by tumbling.

Step 5. The garments were then hung individually on conventional wire clothes hangers which were, in turn, hung at spaced intervals on a continuously moving conveyor which carried the garments past a station 40 at which the outer surfaces of the shirt fronts were lightly sprayed with about 10 cc. to 20 cc. per shirt of a mixture made up as follows:

For a 40 gallon (152 liter) batch, allowing some overage, prepare 32 gallons (122 liters) of filtered water at 70° F. to 80° F. (21° C. 32° C.) by adjusting its pH to 3.5 to 4.5 by adding glacial acetic acid; about 5 oz. (150 ml.) being required;

To 160 oz. (4.8 liters) of this liquid add an equal quantity, 10 pounds (4.5 kg.) of "Zepel" B and add this mixture to the remaining previously prepared water-acetic acid mixture, while stirring slowly;

To 6 oz. (180 ml.) of boiling water, mechanically blend 70 grams Avitex NA softener and add this to the previously prepared liquid mixture;

Add to this mixture 8 gallons (30.4 liters) isoprophyl alcohol and skim and strain surface particles, if any, through cheese cloth to remove them.

"Zepel" is a trademark of E. I. du Pont de Nemours & Company for certain stain repellent compositions, and "Zepel" B and "Zepel" DR are among those polyfluoroalkyl substituted compounds which contain perfluorinated alkyl chains of at least three and as many as 16 carbon atoms, described in U.S. Pat. No. 3,854,871, any of which may be substituted for "Zepel" B in the above mixture.

"Avitex" is a trademark of E. I. du Pont de Nemours & Company for a surface active agent useful as an emulsifier and as a fabric softener. Although it is not specifically described in said U.S. Pat. No. 3,854,871, this patent describes a number of emulsifying agents any of which may be substituted for "Avitex" NA in the above mixture. However, when an anionic detergent is used in Step 3, the emulsifying agent employed in this Step 5 should be cationic in order to maximize the coating of the textile fibers with the sprayed mixture.

The glacial acetic acid is employed to adjust the pH and to stabilize the mixture against deterioration with age, in transport or storage.

Optionally, Oil Bouquet, or any pleasant fragrance, may be employed as a masking agent to conceal the odors of other ingredients of the mixture.

The isoprophyl alcohol, in addition to being a surface active agent, accelerates the evaporation of the liquid in the next step so that a larger proportion of that drying-and-setting step is applied to the setting of the stain repellent material on the fibers of the textile material.

Step 6. The garments, hung on their individual hangers suspended from the continuously moving conveyor, were carried into a 16 foot 3 inch (488 cm.) tunnel 42 the atmosphere of which was heated by introduction of live steam to a temperature of about 325° to 350° F. (163° to 177° C.) through which each garment passed in about one minute.

This step, which has been conventionally used instead of ironing in industrial dry cleaning operations to remove wrinkles from cleaned garments, has an additional effect in the process of the present invention; first evaporating the liquid components of the mixture sprayed on the garments in Step 5 and then heat-setting the stain repellent component of that mixture on the textile fibers.

This completes the process.

EXAMPLE II

The process as described in Example I was applied to soiled work shirts which had previously been treated as described therein, only Step 5 being altered by reducing the quantity of "Zepel" B, or its substitute, to 3.4 lbs (1.53 kg.) per 40 gallon (152 liter) batch of the liquid mixture employed.

We claim:

1. In a process of dry cleaning and finishing garments in which said garments are first dry cleaned and then finished by suspending them from a conveyor and passing them through a steam tunnel in which they are subjected to heat and agitation for the removal of wrinkles, the improvement comprising the application to said garments following such dry cleaning and before entry into said steam tunnel of a stain repellent which is heat-settable within the temperature range to which said garments are exposed in said tunnel, within the time elapsing during their passage therethrough.

2. A process according to claim 1 in which said heat-settable stain repellent is a polyfluoroalkyl substituted compound containing a perfluorinated alkyl chain of at least 3 or as many as 16 carbon atoms.

3. A process according to claim 2 in which the temperature within said steam tunnel is maintained at from 325° to 350° F. (163° to 177° C.) and said garments are exposed thereto for about one minute.

4. A process according to claim 1 in which the application of said heat-settable stain repellent is effected by spraying a dilute liquid mixture thereof on said garments.

5. A process according to claim 4 in which said heat-settable stain repellent liquid mixture is applied by spraying the same only upon the front outer surface of each garment; whereby the absorbency of the inner surface thereof is maintained.

6. A process according to claim 4 in which an anionic detergent is employed in the dry cleaning of said garments and a cationic emulsifying agent is employed in admixture with said sprayed liquid mixture.

7. A process of dry cleaning and finishing garments in which said garments are first dry cleaned by a method including a first agitation in a perchlorethylene-detergent-water mixture; a second agitation in a perchlorethylene-detergent mixture essentially free of water; drying; and then finishing in a steam tunnel for about one minute at a temperature of 325° to 350° F. (163° to 177° C.), characterized by the application by spraying onto the surface of said garments after said second agitation and before finishing a dilute liquid mixture containing a minor amount of polyfluoroalkyl substituted compound containing a perfluorinated alkyl chain of at least 3 or as many as 16 carbon atoms; a major amount of water; an intermediate amount of an alkanol; and an emulsifier.

8. A process according to claim 7 in which said detergent is anionic and said emulsifier is cationic.

9. A process according to claim 7 in which the perchlorethylene-detergent mixture employed in said second agitation is reused in admixture with water in the first agitation of a second batch of garments.

* * * * *